US008875723B2

(12) United States Patent
Brown

(10) Patent No.: US 8,875,723 B2
(45) Date of Patent: Nov. 4, 2014

(54) COUNTER BALANCED COVER FOR TABLE TOP

(76) Inventor: Kent L. Brown, Des Moines, IA (US)

( * ) Notice: Subject to any disclaimer, the term of this patent is extended or adjusted under 35 U.S.C. 154(b) by 295 days.

(21) Appl. No.: 13/338,491

(22) Filed: Dec. 28, 2011

(65) Prior Publication Data

US 2013/0167890 A1 Jul. 4, 2013

(51) Int. Cl.
*A45B 3/00* (2006.01)
*A47B 37/04* (2006.01)

(52) U.S. Cl.
CPC .. *A45B 3/00* (2013.01); *A47B 37/04* (2013.01)
USPC ..... 135/16; 135/20.3; 135/98; 108/50.12; 108/144.11

(58) Field of Classification Search
CPC ..... A45B 3/00; A45B 19/00; A45B 19/04; A45B 2200/1063; E04H 15/02; E04H 15/28; A47B 9/00; A47B 9/12; A47B 9/20; A47B 37/04
USPC ..... 135/16, 20.3, 98, 141–142, 905; 108/50.11–50.12, 144.11, 147; 248/511, 519, 528, 529, 123.11, 123.2, 248/125.8
See application file for complete search history.

(56) References Cited

U.S. PATENT DOCUMENTS

| | | | | | |
|---|---|---|---|---|---|
| 1,302,321 | A * | 4/1919 | Daniel | 280/87.05 |
| 2,190,498 | A * | 2/1940 | Williams | 312/243 |
| 2,782,085 | A * | 2/1957 | Natale | 108/94 |
| 3,490,469 | A * | 1/1970 | Dubinsky | 135/34.2 |
| 4,353,659 | A * | 10/1982 | Comte | 403/24 |
| 5,740,822 | A * | 4/1998 | Einck | 135/16 |
| 6,129,101 | A * | 10/2000 | Dubinsky | 135/20.3 |
| 7,549,430 | B1 * | 6/2009 | Gravlee | 135/16 |
| 7,631,653 | B2 * | 12/2009 | Young et al. | 135/15.1 |
| 2006/0272555 | A1 * | 12/2006 | Carter | 108/50.12 |
| 2009/0165681 | A1 * | 7/2009 | Smith et al. | 108/50.12 |
| 2009/0314319 | A1 * | 12/2009 | Young et al. | 135/16 |

* cited by examiner

*Primary Examiner* — Winnie Yip
(74) *Attorney, Agent, or Firm* — Zarley Law Firm, P.L.C.

(57) ABSTRACT

A cover system includes a cover, a post, a table top, a counter weight assembly, and a base. The counter weight assembly has a cable extending through at least one pulley and connected to a counter weight. The counter weight assembly is connected to the post and the table top such that as the table top is raised, the post and cover are lowered.

9 Claims, 3 Drawing Sheets

COUNTER BALANCED COVER FOR TABLE TOP

BACKGROUND OF THE INVENTION

This invention is directed to a cover system for a table top and more specifically, and without limitation, a counter balanced cover for a table top.

Outdoor furniture such as patio furniture is well known in the art. Included in this category are tables with awnings that are either attached to or inserted within a table. While the awnings provide shade from the sun and cover from the rain, they provide only indirect cover for the table top. Because there is not direct cover the table tops become dirty requiring time and effort to wipe them clean. Further, during storms, or when not in use, sometimes the awnings need to be removed and stored which requires time, labor, and space.

Therefore, there exists a need in the art for a system that addresses these deficiencies.

An objective of the present invention is to provide a cover system that easily and directly covers a table top.

A further objective of the present invention is to provide a cover system that does not require dismantling for storms and/or storage.

These and other objectives will be apparent to one of ordinary skill in the art based on the following written description, drawings, and claims.

SUMMARY OF THE INVENTION

A cover system includes a cover connected to a post. The post extends through an opening in a table top. The table is connected to a sidewall that is connected to a base. A counter weight assembly is connected to the post and the table top or sidewall such that as the table top is raised the cover is lowered.

DETAILED DESCRIPTION OF THE PREFERRED EMBODIMENT

Figure 1:
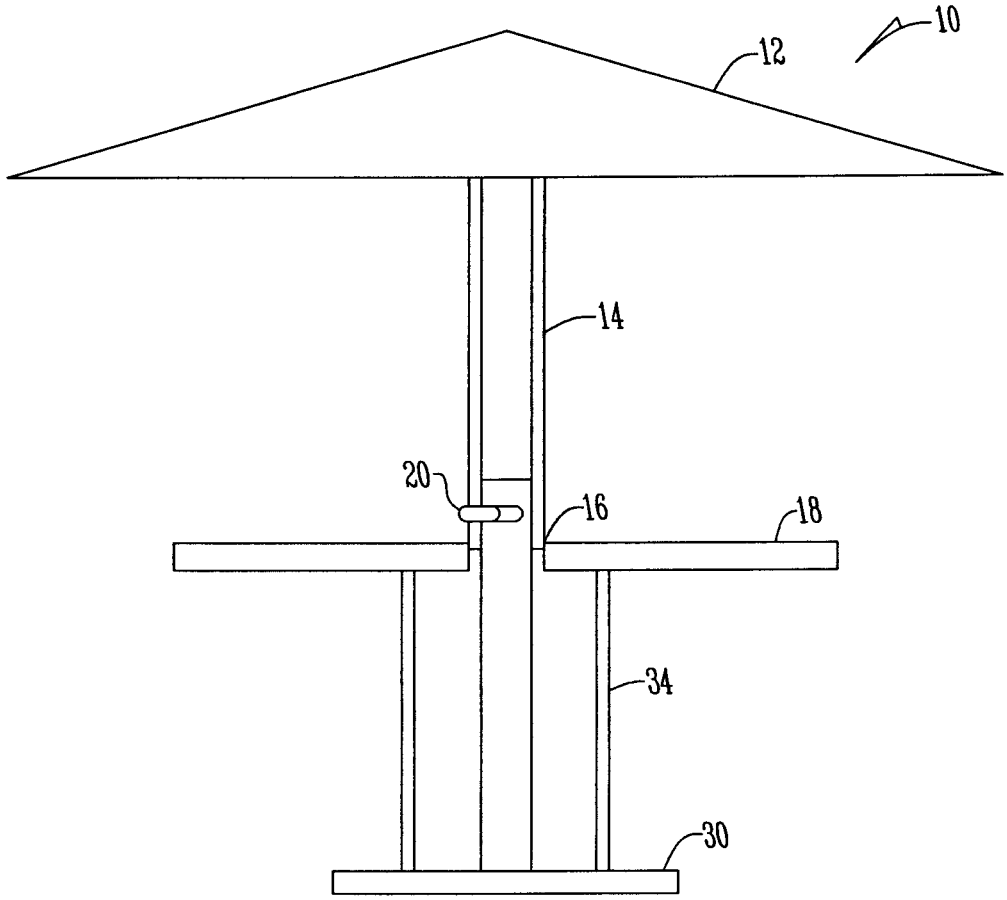
FIG. 1 is a side view of a cover system with a telescopic post.
Figure 2:
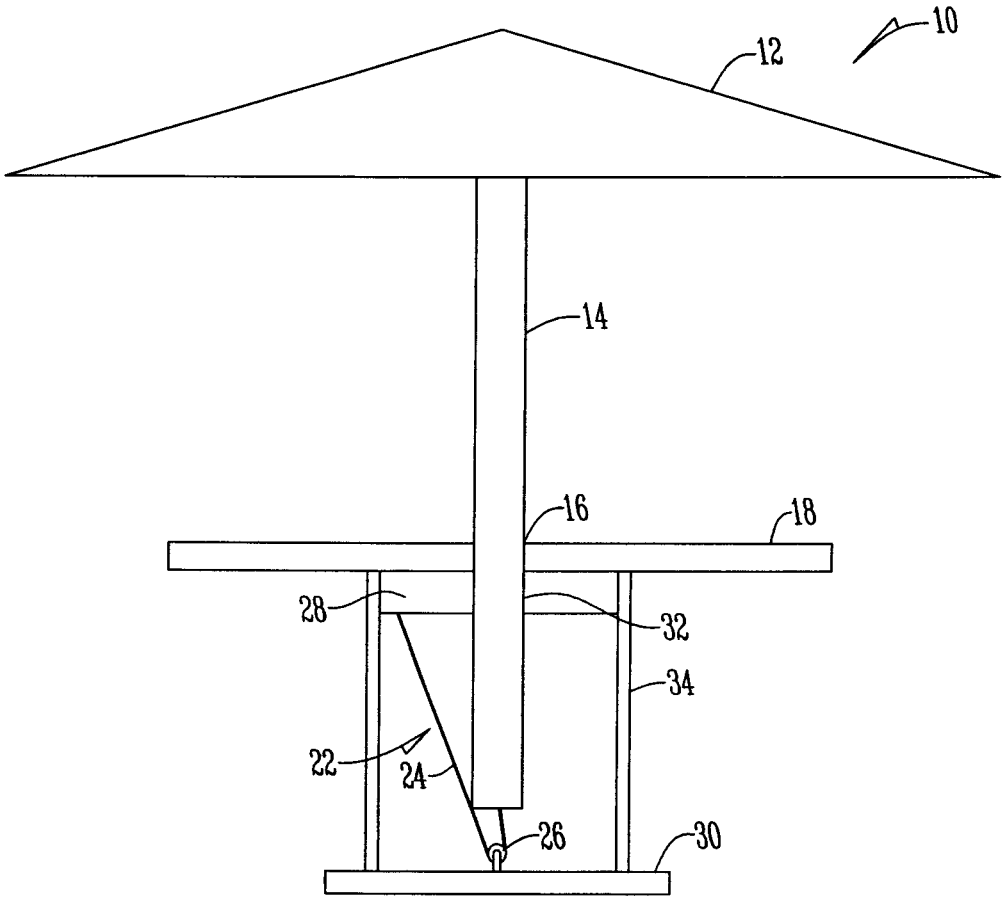
FIG. 2 is a side view of a cover system in an open position.
Figure 3:
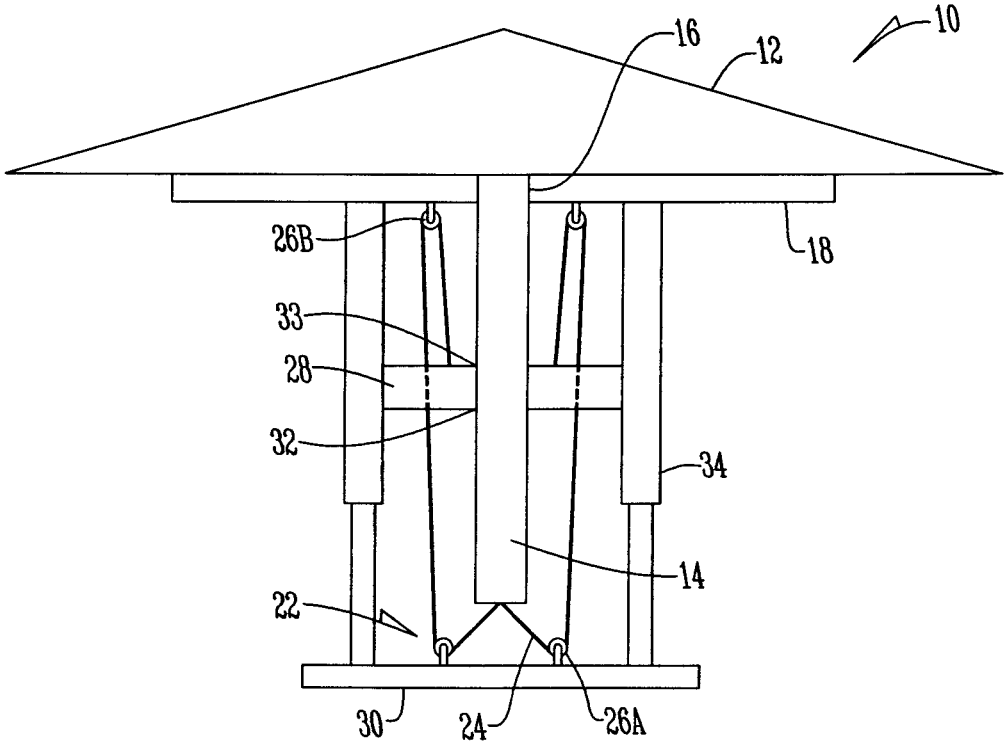
FIG. 3 is a side view of a cover system in a closed position.

Referring to the Figures, the cover system 10 includes an awning or cover 12 attached to a post 14. Preferably, the cover 12 is moveable from an expanded open position to a contracted closed position. The post 14 is inserted through an opening 16 in the table top 18. In one embodiment the post includes a plurality of sections that are telescopically connected to one another with at least one locking member 20 such as a pin and detent to hold the sections in an extended position.

In another embodiment, the post 14 is an elongated member that is connected to an actuating member 22 such as a counter balance assembly or a mechanical, electrical or hydraulic system. Preferably the counter balance assembly 24 is of any type and preferably includes a cable 24, a plurality of pulleys 26, and at least one counter weight 28. The cable 24 is attached at one end to the post 14, extends through a first pulley 26A preferably attached to a base 30 to a second pulley 26B preferably attached to the table top 18, and is connected at the opposite end to the counter weight 28.

Preferably, the counter weight 28 surrounds the post 14 such that the post 14 slides through an opening 32 in the counter weight 28. The counter weight 28 is attached to a sidewall 34 which extends between and is connected to the table top 18 and the base 30. In one embodiment, the counter weight 28 is slidably attached to the sidewall 34. Alternatively, the sidewall 38 includes at least two sections 34A and 34B that are telescopically connected to one another.

In yet another embodiment the counter weight 28 is attached to the bottom of the table top 18 and is moveable within the sidewall 34 which is attached only at the base 30. The cable is attached to the post 14 and extends through a pulley 26 and is attached to the counter weight 28 at the opposite end.

In operation, the cover system 10 typically is in an open position where the cover 12 is raised in spaced relation to the table top 18. The cover 12 is moved to a closed or covering position in a number of ways. In one embodiment the locking member 20 is released and the post 14 is telescopically lowered until the cover 12 engages the table top 18. In another embodiment, the table top 18 is raised toward the cover 12. The raising of the table top 18 also raises counter weight 28 which in turn pulls the post downward through openings 16 and 32 causing the cover 12 to lower and engage the table top 18.

Accordingly, a cover system has been disclosed that, at the very least, meets all the stated objectives.

What is claimed is:

1. A cover system, comprising:

a cover attached to a post at a first end, the post having a plurality of sections that are telescopically connected to one another and extend through an opening in a table top;

a base connected to the second end of the post and the table top; and a counter balance assembly having a counter weight slidably receiving the post within an opening in the counter weight, a cable, a first pulley attached to the base, a second pulley attached to the table top wherein the cable is attached to the post at one end, extends through the first pulley and the second pulley and is attached to the counterweight at the opposite end, wherein when the table top is raised the cover is lowered.

2. The cover system of claim 1 wherein the counter weight is attached to a sidewall that extends between the table top and the base.

3. The cover system of claim 2 wherein the counter weight is slidably attached to the side wall.

4. The cover system of claim 2 wherein the sidewall includes at least two sections telescopically connected to one another.

5. A cover system, comprising:

a cover attached to a post at a first end that extends through an opening in a table top;

a counter weight assembly attached to the post at a second end, the table top, and a base;

wherein the counter weight assembly includes at least one counter weight slidably receiving the post within an opening in the at least one counter weight, and a cable with a first end attached at the second end of the post and extending through at least one pulley and connected to the at least one counter weight at the opposite end of the cable, wherein when the table top is raised the cover is lowered.

6. The cover system of claim 5 wherein the counter weight is attached to the table top.

7. The cover system of claim 5 wherein the counter weight assembly includes a counter weight that is attached to a side-wall that extends between the table top and the base.

8. The cover system of claim 7 wherein the counter weight is slidably attached to the side wall.

9. The cover system of claim 7 wherein the sidewall includes at least two sections telescopically connected to one another.

* * * * *